US006712554B1

(12) United States Patent
Froehly

(10) Patent No.: US 6,712,554 B1
(45) Date of Patent: Mar. 30, 2004

(54) MODULAR DRAINAGE UNIT

(76) Inventor: Jean-Louis Froehly, 13, rue de Courtavon, 68480 Levoncourt (FR)

( * ) Notice: Subject to any disclaimer, the term of this patent is extended or adjusted under 35 U.S.C. 154(b) by 0 days.

(21) Appl. No.: 10/089,477

(22) PCT Filed: Sep. 28, 2000

(86) PCT No.: PCT/FR00/02685

§ 371 (c)(1),
(2), (4) Date: Mar. 28, 2002

(87) PCT Pub. No.: WO01/23672

PCT Pub. Date: Apr. 5, 2001

(30) Foreign Application Priority Data

Sep. 29, 1999 (FR) ..... 99 12332

(51) Int. Cl.[7] ..... E02B 11/00; E02B 13/00
(52) U.S. Cl. ..... 405/45; 405/43; 405/36
(58) Field of Search ..... 405/36, 38, 39, 405/40, 43, 44, 45, 47, 51, 52; 52/169.5

(56) References Cited

U.S. PATENT DOCUMENTS

| | | | | |
|---|---|---|---|---|
| 3,440,823 A | | 4/1969 | Olsen | |
| 4,182,581 A | * | 1/1980 | Uehara et al. | 405/43 |
| 5,275,506 A | * | 1/1994 | Grimsley | 405/43 |
| 5,573,349 A | * | 11/1996 | Paoluccio | 405/52 |
| 5,639,364 A | * | 6/1997 | Houck et al. | 405/43 X |

FOREIGN PATENT DOCUMENTS

| | | |
|---|---|---|
| DE | 2207216 | 8/1973 |
| FR | 2420071 | 10/1979 |
| FR | 2798944 | 9/1999 |
| NL | 6818081 | 6/1970 |
| NL | 7211660 | 9/1973 |
| WO | 9743895 | 11/1997 |

* cited by examiner

*Primary Examiner*—Heather Shackelford
*Assistant Examiner*—Sunil Singh
(74) *Attorney, Agent, or Firm*—Davis & Bujold, PLLC

(57) ABSTRACT

An economical, efficient, practical and easy-to-use modular drainage unit capable of efficiently collecting and evacuating drainage water and designed to provide a global solution for producing a very simple drainage process. The modular drainage unit (1) is characterized in that it comprises an elongated body (2), traversed by a longitudinal collecting conduit (3), and comprising flow passages (5) opening on the peripheral walls of the body (2) and emerging into the conduit (3), the flow passages (5) being arranged to enable drainage water to circulate by gravity towards the collecting conduit (3), and it comprises connecting method (6) designed to assemble two successive drainage units (1) and further comprises an outer water permeable casing (7) to trap soil. The invention is useful for draining grounds in general and around buildings.

12 Claims, 4 Drawing Sheets

MODULAR DRAINAGE UNIT

This application is a national stage completion of PCT/FR00/02685 filed Sep. 28, 2000 which claims priority from French Application Serial No. FR 99/12332 filed Sep. 29, 1999.

FIELD OF THE INVENTION

This invention concerns a modular drainage unit intended for soil draining in general and draining around buildings and housing in particular.

BACKGROUND OF THE INVENTION

The laying of a traditional drainage system is difficult and requires considerable and expensive means. In particular, it comprises the following operations: the digging of a trench, which is then lined with a geotextile fabric; a long pierced pipe (usually made from PVC) is then laid in the trench and covered with gravel; the geotextile fabric is folded over and the trench is filled in. Such a system therefore has many drawbacks. The geotextile fabric tends to slip down the sides of the trench when the gravel is poured and is frequently buried under the gravel. The drainage pipe tends to rise in the trench as a result of its rigidity and the vibration generated by pouring the gravel. When temperatures fall below −10° C., the PVC pipe becomes brittle. Moreover, such drainage pipes are difficult to handle and therefore difficult to lay alone. The cost of laying is high, if one counts the purchase and delivery of the gravel and the labor required.

A number of solutions have been devised to solve part of these problems. Publication DE-A-22 07 216 describes a monoblock drainage unit with a square cross-section, traversed by a central longitudinal collecting conduit, made from a grainy material. This restricts the passage of the drainage water considerably and therefore does not permit effective drainage. Moreover, there is no system to direct the drainage water to the collecting conduit, and as a result part of the water is evacuated into the fill. Publication U.S. Pat No. 3,440,823 describes a drainage system with two separate components: a drainage conduit in the shape of an inverted V, placed on a impermeable base. The pipe comprises only very few side channels on the edges of the V, which are not sufficient to capture the drainage water. Moreover, the inverted-V shape is not resistant enough to crushing by the fill. Finally, publication NL-A-7 211 660 describes a drainage unit traversed by a central longitudinal collecting conduit. This unit is limited to the capture of rainwater in gutters, as it comprises openings only on its upper part.

Therefore, no existing system provides an effective, reliable, simple and economical solution to the problem of drainage.

The purpose of this invention is to supply such a solution, in the form of a drainage unit which is effective, practical, easy to use and able to capture and evacuate drainage water efficiently.

SUMMARY OF THE INVENTION

The invention comprises a modular drainage unit, characterized in that it comprises an elongated body, traversed by a longitudinal collecting conduit and comprising flow passages opening on the peripheral walls of said body and emerging into said collecting conduit, said flow passages being arranged to enable drainage water to circulate by gravity towards said collecting conduit, in that it comprises connecting means designed to assemble two consecutive drainage units and in that it comprises a water permeable outer casing.

The flow passages may take the form of peripheral grooves emerging into said collecting conduit by transverse channels, transverse channels running from said peripheral walls to said collecting conduit, peripheral baffles emerging into said collecting conduit by side channels, or the interstices of a porous structure forming said body.

In a preferred form of the invention, the connecting means comprise a coupling separate from said body, the outer dimensions of which do not exceed the bore of said collecting conduit, this coupling being designed to fit into the extremities facing the collecting conduits of two consecutive drainage units.

One possible variation is that the connecting means may comprise a coupling integral to said body, prolonging one of the extremities of the collecting conduit and designed to form a male part, the other extremity of the collecting conduit being designed to form a female part designed to receive the male part of an adjacent drainage unit.

The connecting means also advantageously comprise at least one lateral opening in said body at the same level as said collecting conduit, the dimensions of this lateral opening being more or less equal to those of said collecting conduit, emerging into the latter, and designed to receive said coupling designed to assemble two consecutive drainage units at right angles.

Depending on the preferred form of implementation, the outer casing is composed of a geotextile fabric, this fabric being wrapped around said body and being longer on one side, so as to cover partially the next drainage unit.

The body may be manufactured from a water impermeable material selected from the group comprising at least polystyrene, polyvinyl chloride, concrete, synthetic resin and any molded or extruded synthetic material.

The body may also be manufactured from a water permeable material selected from the group comprising at least expanded polystyrene and any structured or foamed synthetic material. In this case, the body may comprise a watertight area located under the collecting conduit and comprising a base made from an impermeable material incorporated in or under said body. The collecting conduit may also comprise a watertight inner casing, if necessary.

BRIEF DESCRIPTION OF THE DRAWINGS

This invention and its advantages will appear more fully in the following (non-exhaustive) description of instances of implementation, with reference to the attached illustrations, in which:

Illustration 1 is a schematic sectional view of soil drainage around a building as performed as per the traditional former method (left) and as per the invention (right), Illustration 2 is a plan view of a drainage unit without its casing, Illustration 3 is a cross-sectional and perspective view of the drainage unit in Illustration 2, Illustration 4 is an exploded view of two drainage units to be assembled at right angles, Illustrations 5A and 5B are perspective and cross-sectional views respectively of a drainage unit with slight differences in implementation, and Illustrations 6 and 7 are perspective views of two other variations on the drainage unit as per the invention.

DETAILED DESCRIPTION OF THE INVENTION

Figure 1:
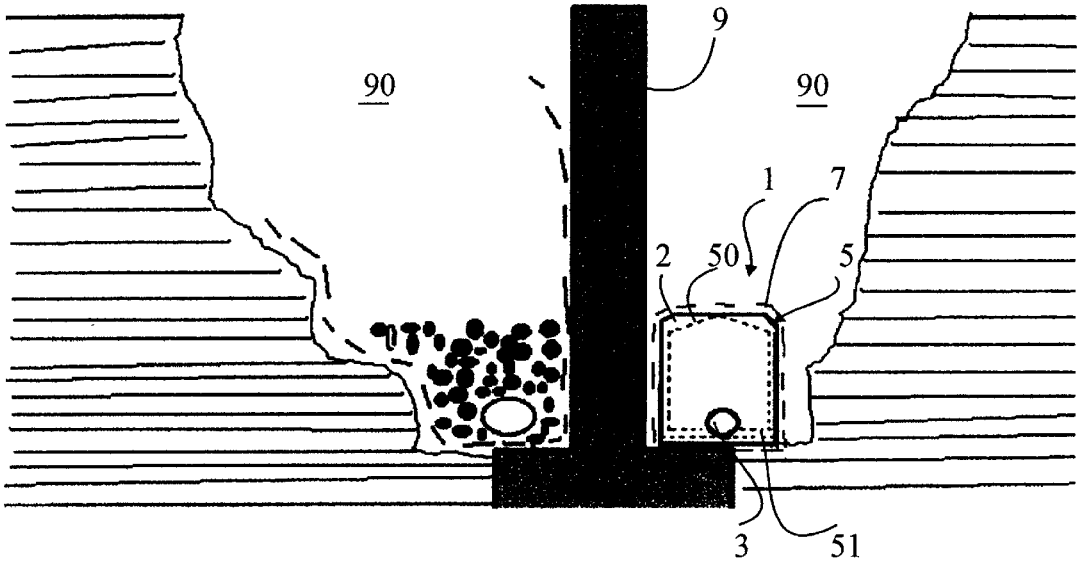
Figure 5A:
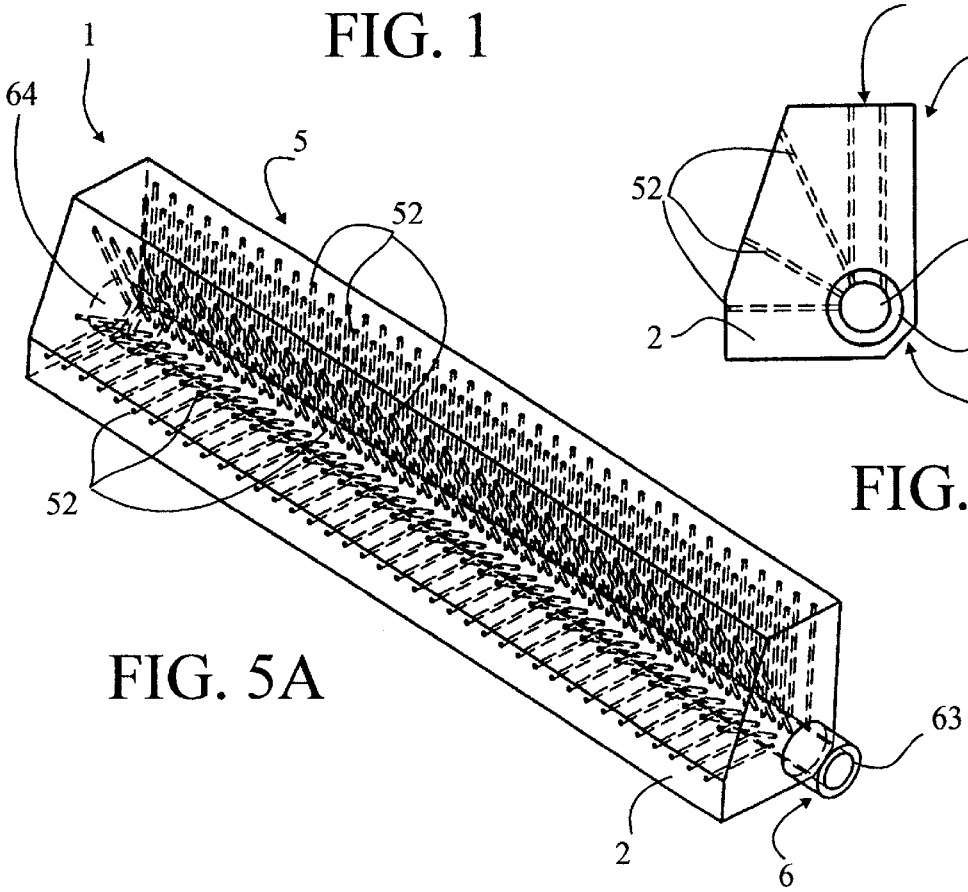
Figure 5B:
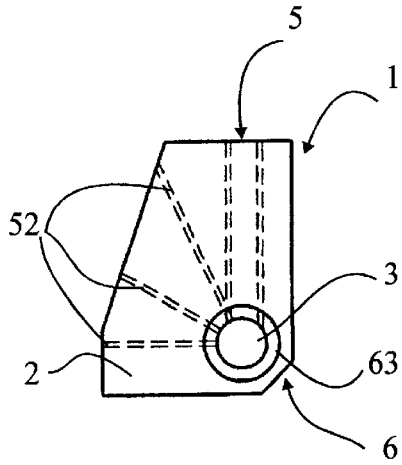
Figure 2:
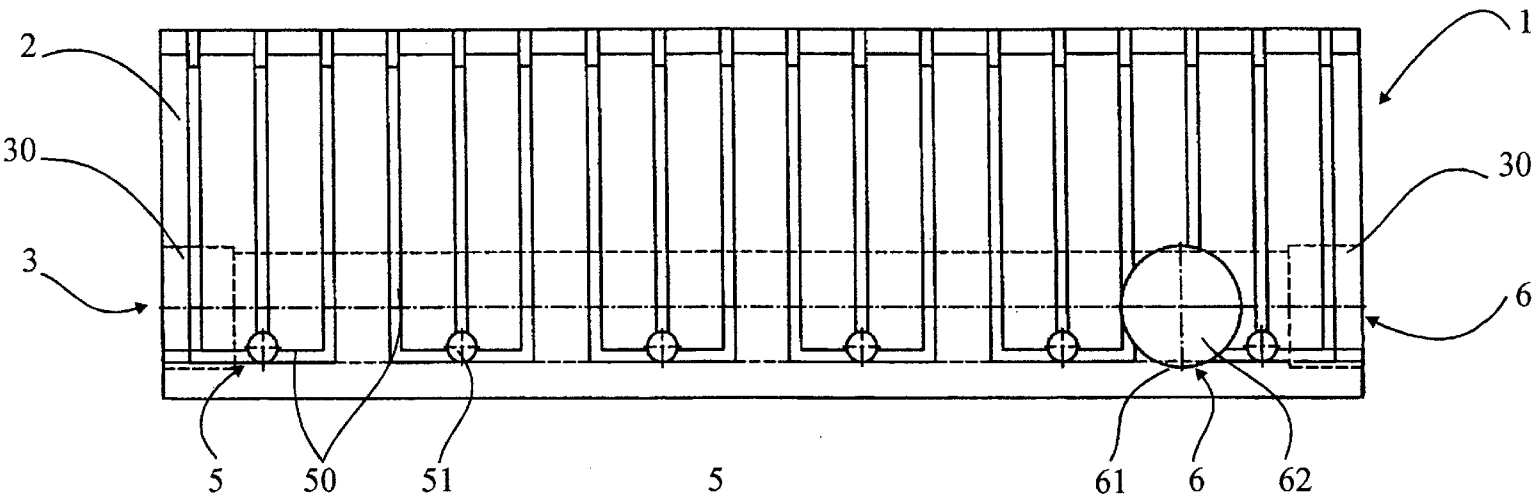
Figure 3:
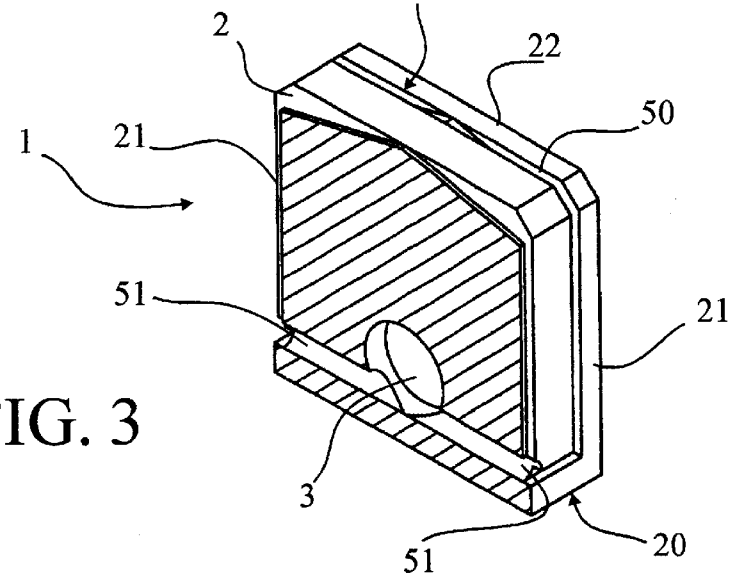
Figure 4:
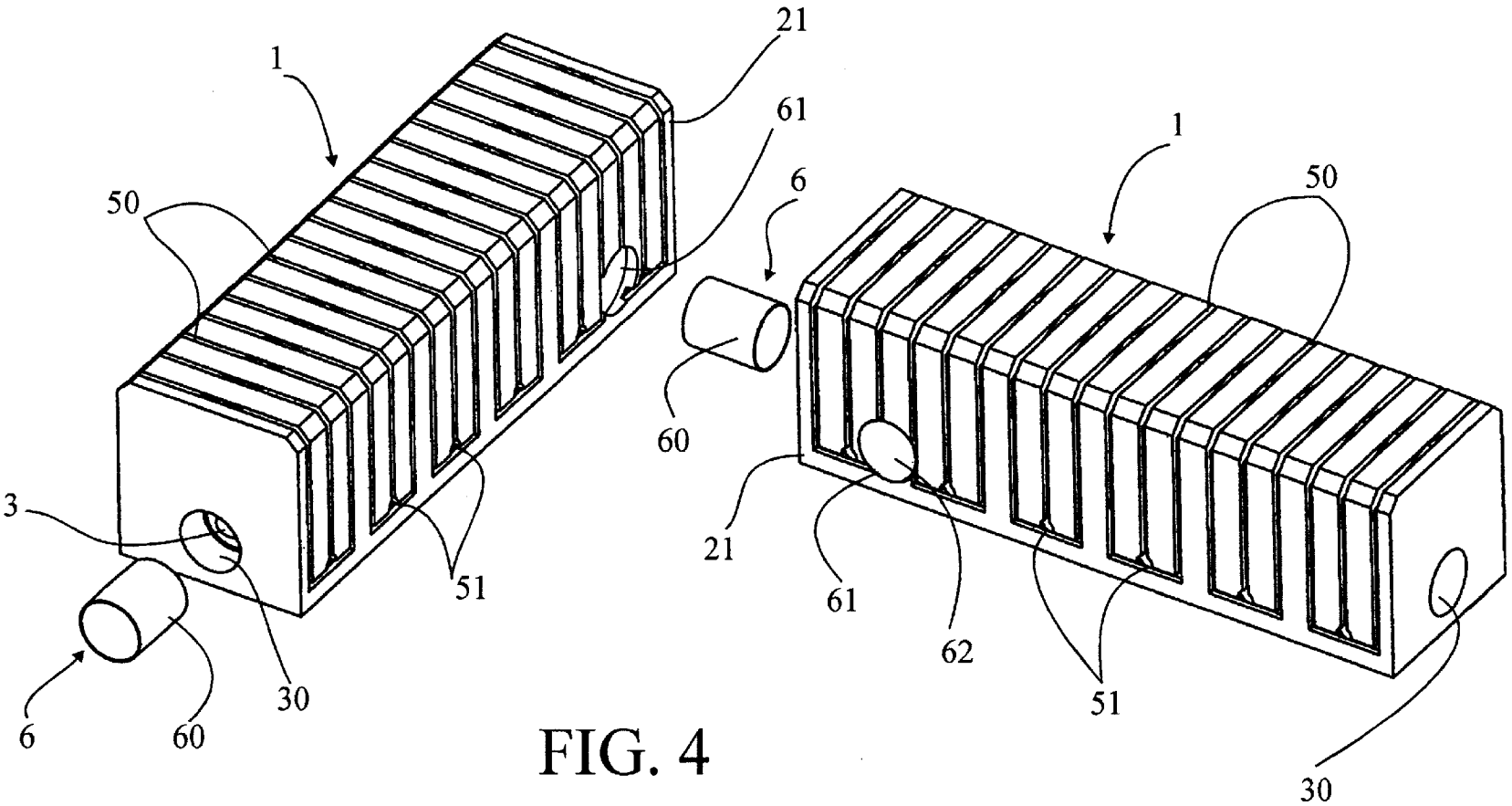
Figure 6:
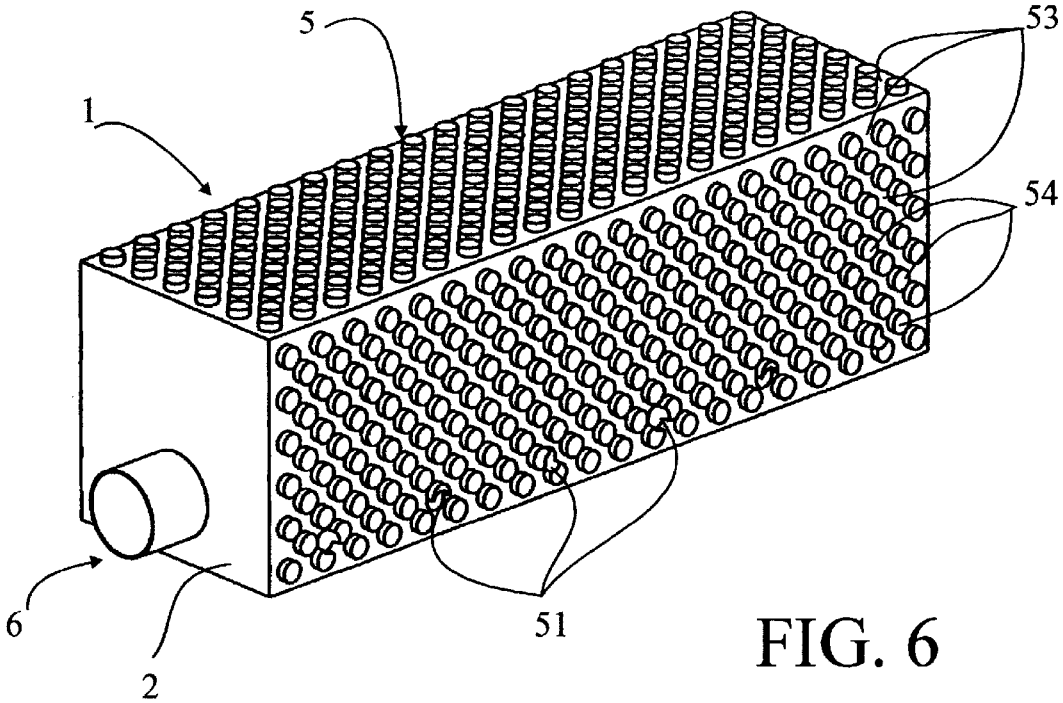
Figure 7:
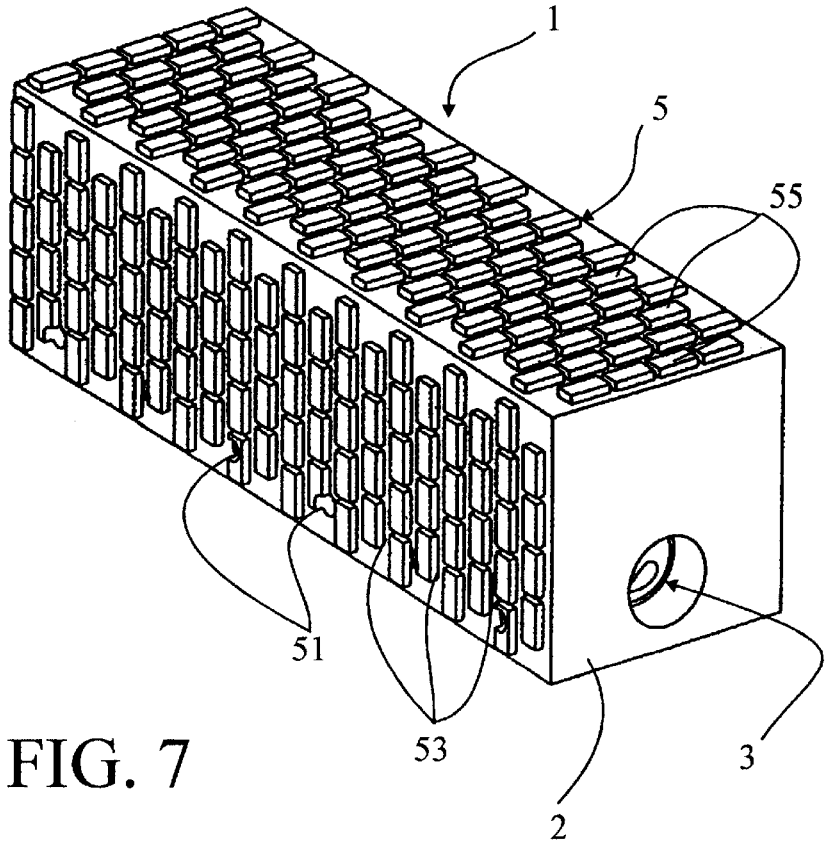

With reference to Illustrations 1 and 3, the modular drainage unit 1 as per the invention is intended to drain soil, for instance, though not exclusively, around a building or dwelling. It comprises an elongated body 2 traversed by a longitudinal collecting conduit 3, and flow passages 5 opening on the peripheral walls of the body 2 and emerging into the collecting conduit 3, being arranged to enable drainage water to circulate by gravity to said conduit. It further comprises connecting means 6 designed to assemble two successive drainage units 1 and an outer water permeable casing 7 shown only by the dotted line in Illustration 1.

The elongated body 2 must be able to withstand the pressure of a load of soil. For this purpose, its cross-section is preferably polygonal, or may be semicircular. Its shape defines at least one flat base 20 and one flat side wall 21 perpendicular to said base and which enables the modular drainage unit 1 to be positioned at the base and along the foundations 9 of a building.

This body 2 may be manufactured from a water impermeable material such as polystyrene, polyvinyl chloride, concrete, synthetic resin or any other equivalent material, synthetic or otherwise, molded or extruded. It made also be made from a water permeable material such as expanded polystyrene of varying density, or any other structured (e.g. honeycombed) or foamed synthetic material. What is important is that the combination of the geometry of this body and of its material or structure gives it sufficient resistance to crushing to withstand a load of soil.

In the case of a water permeable material, a watertight area may be provided under the collecting conduit 3 to prevent the drainage water from seeping into the soil. This watertight area may take the form of a base (not shown) made from an impermeable material incorporated in or under the body 2.

The longitudinal collecting conduit 3 is preferably placed in the lower part of body 2 to collect drainage water by gravity. It is rectilinear and more or less parallel to the base 20 of said body. Its cross-section is circular but may be of another shape. Depending on requirements and the material of the body 2, it may comprise a watertight internal casing (not shown), inserted or integrated, for instance by overmolding. This collecting conduit 3 also comprises extremities 30 larger in diameter, designed to receive the connecting means 6 described hereunder.

In this example, the flow passages 5 take the form of peripheral grooves 50 emerging into the collecting conduit 3 by transverse channels 51 on either side of said conduit. The peripheral grooves 50 are more or less identical and have a U-shaped profile, but the profile shape could be different, as well as the depth. They are located on the top 22 and side walls 21 of the body 2. They are rectilinear and located at regular intervals along the entire length of the drainage unit 1. The cross-section of the drainage unit 1 shown by Illustration 3 shows that in the middle of and next to the top wall 22 each channel 50 forms a summit with two slopes which enable the drainage water to circulate by gravity.

The transverse channels 51 are more or less perpendicular to the collecting conduit 3 and designed so as to emerge into said collecting conduit 3 tangent to its bottom. They are identical and have a circular cross-section, but this cross-section could be of a different shape. They may be slightly inclined towards said collecting conduit 3 to encourage the circulation of drainage water by gravity. In the example shown, each transverse channel 51 is connected to three peripheral grooves 50. The cross-section of each transverse channel 51 is larger than that of the peripheral grooves 50, just as the cross-section of the collecting conduit 3 is noticeably larger than that of the transverse channels 51, so that they can accommodate the flow of the drainage water.

In the example illustrated by Illustration 4, the connecting means 6 comprise a coupling 60 separate from the body 2, cylindrical and with an outer diameter no larger than the bore of the extremities 30 of the collecting conduit 3. This coupling 60 is intended to fit into the extremities 30, facing the collecting conduits 3 of two consecutive drainage units 1, in order to connect them in a linear manner.

These connecting means 6 also comprise a lateral opening 61 in each side wall 21 of the body 2 at the same level as the collecting conduit 3, next to one of its extremities and emerging into this conduit. These lateral openings are circular, but may be of a different shape, and their diameter is more or less the same as that of the extremities 30 of said conduit. They are designed to receive the coupling 60 and enable two consecutive drainage units 1 to be assembled at right angles, as shown in Illustration 4. These lateral openings 61 are defined by a precut area 62 in the side walls 21 of said body 2. To use them, the precut area 62 must be removed, and is then used to plug extremity 30 of the corresponding collecting conduit 3.

The outer casing 7 is made of a fabric made of a geotextile material, more or less rectangular in shape, designed to be wrapped around the body 2 and if necessary stapled to the body. The longitudinal dimensions of this fabric 7 are larger than those of the drainage unit 1, so as to cover at least partially the following drainage unit 1. Thus, the join area between the two consecutive drainage units 1 is also covered. This fabric 7 retains particles of soil, stones and all other materials which may block the flow passages 5 of drainage unit 1 and thus render the latter ineffective. Of course, other equivalent means may be used, such as a cover with a very fine mesh, glued, overmolded or inserted around said body 2.

The use and implementation of modular drainage unit 1 as per the invention are very simple. The drainage units 1, made for instance of expanded polystyrene, are inexpensive, very light, easy to handle and process, and can be laid in all weathers, even at very low temperatures. Moreover, they are nonpollutant, rotproof and do not retain the damp.

Illustration 1 enables a very clear comparison to be made between the traditional drainage method (left) and that using the drainage unit 1 as per the invention (right). A trench 90 is dug around the foundations 9 of a building. In the traditional method, the trench is covered with geotextile fabric, the pierced collecting pipe is laid, gravel is poured on top of it and covered with the two flaps of geotextile, and the trench is filled.

Using the drainage unit 1 of the invention, the drainage units 1 are positioned directly at the bottom of the slightly sloping trench 90, they are assembled with each other using the couplings 60, then the trench is filled in. It is obvious that the installation of a drainage system is made much easier by the fact that the drainage unit 1 combines the collecting conduit, the flow passages and the geotextile filter in a single unit.

Once in place, this drainage system ensures effective and durable drainage, as the drainage units 1 are dimensionally very stable despite potential land slip. The drainage water is filtered by the geotextile casing 7 and channeled by the peripheral grooves 50, through which it flows by gravity to the transverse channels 51, which centralize it in the collecting conduit 3. It then flows into the sewerage system.

Thus, the purpose of the invention is fully met.

However, the invention is not limited to the instance of implementation described, but extends to all versions and variations obvious to a professional.

In particular, and with reference to Illustrations 5A and 5B, the flow passages 5 may take the form of a multitude of transverse channels 52, rectilinear and with a small section, running directly from the peripheral walls of the body 2 of the drainage unit 1 to the collecting conduit 3. In this instance, the connecting means 6 are composed of a coupling 63 integral to the body 2, prolonging one of the extremities of the collecting conduit 3 and designed to form a male part. The other extremity 64 of the collecting conduit 3 is designed to form a female part intended to receive the male part 63 of an adjacent drainage unit 1.

With reference to Illustrations 6 and 7, the flow passages 5 may also be formed by peripheral baffles 53 emerging into the collecting conduit 3 via transverse channels 51. These peripheral baffles 53 may take the form of shapes in relief located on the periphery of the body 2, such as round studs 54 (see Ill. 6) or rectangular studs 55 (see Ill. 7), or any other geometrical shape.

Another solution is to manufacture the body 2 using a porous structure, the flow passages 5 being formed by the interstices of this porous structure.

Of course, the shape and dimensions of the drainage unit and its various conduits and channels may differ, without ceasing to be covered by the protection defined by the attached claims.

What is claimed is:

1. A modular drainage unit (1) comprising:

an elongated body (2) having a polygonal cross-section houses in its lower portion near to its bottom a longitudinal collecting conduit (3);

a plurality of flow passages (5) in its upper portion extending from its peripheral walls and emerging into said longitudinal collecting conduit (3) by transverse channels (51) housed in its lower portion, the flow passages (5) being arranged to enable drainage water to flow by gravity into the collecting conduit (3);

the elongated body further comprising connecting means (6) designed to assemble two consecutive drainage units (1), and a water permeable outer casing (7) surrounding the elongate body.

2. The modular drainage unit according to claim 1, wherein the flow passages (5) take the form of peripheral grooves (50).

3. The modular drainage unit according to claim 1, wherein the flow passages (5) are peripheral baffles (53).

4. The modular drainage unit according to claim 1, wherein the connecting means (6) comprises a coupling (60) separate from the body (2), the outer dimensions of which do not exceed a bore of the collecting conduit (3), this coupling (60) being designed to fit into the bores of the collecting conduits at facing extremities of two consecutive and aligned, drainage units (1).

5. The modular drainage unit according to claim 4, wherein the connecting means (6) comprises at least one lateral opening (61) made in the body (2) at the same level as the collecting conduit (3), the dimensions of this lateral opening (61) being more or less equal to those of the collecting conduit (3), emerging into the latter, and designed to receive the coupling (60) to assemble two consecutive drainage units (1) at a right angle.

6. The modular drainage unit according to claim 1, wherein the connecting means (6) comprises a male coupling (63) integral to the body (2), extending an extremity of the collecting conduit (3) and designed to engage a female coupling at an extremity of another collecting conduit (3) of an adjacent drainage unit (1).

7. The modular drainage unit according to claim 1, wherein the outer casing (7) is made of a fabric made from geotextile material, this fabric being wrapped around the body (2) and being longer on one side, so as to cover at least in part the following drainage unit (1).

8. The modular drainage unit according to claim 1, wherein the body (2) is made from a water impermeable material from the group comprising at least polystyrene, polyvinyl chloride, concrete, synthetic material.

9. The modular drainage unit according to claim 1, wherein the body (2) is made from a water permeable material from the group comprising at least expanded polystyrene and foamed synthetic material.

10. The modular drainage unit according to claim 9, wherein the body (2) comprises a watertight area placed under the collecting conduit and composed of a base made from an impermeable material incorporated under or into the body.

11. A modular drainage unit system comprising at least two modular drainage units (1) with each modular drainage unit (1) comprising:

an elongated body (2) having a transverse polygonal cross-section having an upper surface and bottom surface, the elongated body (2) housing a longitudinal extending collecting conduit (3) which facilitates drainage of liquid via the modular drainage unit (1), and the collecting conduit (3) being spaced from the upper surface and adjacent the bottom surface;

a plurality of flow passages (5) formed in at least the upper surface of each modular drainage unit (1) and communicating with the longitudinal collecting conduit (3) via a transverse channel (51, 52) extending through a peripheral wall of the modular drainage unit (1), and each the flow passages (5) being arranged to facilitate drainage of water to the collecting conduit (3) by gravity;

each elongated body (2) having a connecting means (6) facilitating assembly of two consecutive drainage units (1) with one another, and a water permeable outer casing (7) surrounding the elongate body (2) of each modular drainage unit (1) which permits passage of water therethrough but blocks passage of stone and other material which may obstruct the flow passages (5).

12. A modular drainage unit system comprising at least two modular drainage units (1) with each modular drainage unit (1) comprising:

an elongated body (2) having a transverse polygonal cross-section having an upper surface and flat bottom surface, the elongated body (2) being constructed from a material which is able to withstand soil pressure, the elongated body (2) housing a longitudinal extending collecting conduit (3) which facilitates drainage of liquid via the modular drainage unit (1), and the collecting conduit (3) being spaced from the upper surface and adjacent the bottom surface;

a plurality of flow passages (5) formed in at least the upper surface of each modular drainage unit (1), a plurality of transverse channels (51, 52) extending through a peripheral wall of the elongated body (2) and communicating with the longitudinal collecting conduit (3) to facilitate drainage of from the plurality of flow passages (5) to the collecting conduit (3) by gravity;

each elongated body (2) having a connecting means (6) facilitating assembly of two consecutive drainage units (1) with one another, and a water permeable outer casing (7) surrounding the elongate body (2) of each modular drainage unit (1) which permits passage of water therethrough but blocks passage of stone and other material which may obstruct the flow passages (5).

* * * * *